United States Patent [19]

Derr et al.

[11] 4,059,648

[45] Nov. 22, 1977

[54] METHOD FOR UPGRADING SYNTHETIC OILS BOILING ABOVE GASOLINE BOILING MATERIAL

[75] Inventors: Walter R. Derr, Voorhees, N.J.; Joseph R. McClernon, Morrisville, Pa.; Stephen J. McGovern, Bellmawr; Fritz A. Smith, Haddonfield, both of N.J.

[73] Assignee: Mobil Oil Corporation, New York, N.Y.

[21] Appl. No.: 703,887

[22] Filed: July 9, 1976

[51] Int. Cl.[2] ..... C07C 1/04

[52] U.S. Cl. ..... 260/676 R; 208/57; 260/450

[58] Field of Search ..... 208/57, 59, 143, 144; 260/450, 676

[56] References Cited

U.S. PATENT DOCUMENTS

| | | | |
|---|---|---|---|
| 2,678,263 | 5/1954 | Glazier | 208/17 |
| 2,692,888 | 10/1954 | Throckmorton et al. | 208/144 |
| 2,819,289 | 1/1958 | Luben | 260/450 |
| 3,256,178 | 6/1966 | Hass et al. | 208/57 |
| 3,671,419 | 6/1972 | Ireland et al. | 208/57 |
| 3,720,601 | 3/1973 | Coonradt et al. | 208/59 |
| 3,870,624 | 3/1975 | Tice et al. | 208/143 |

*Primary Examiner*—Herbert Levine
*Attorney, Agent, or Firm*—Charles A. Huggett; Carl D. Farnsworth

[57] ABSTRACT

Upgrading a product of Fischer-Tropsch Synthesis boiling above 300° F is accomplished in a combination operation comprising hydrotreating of the 300° F plus product and selective cracking portions of the hydrotreated product to provide a product slate comprising gas, gasoline, jet fuel, light and heavy oil fractions.

4 Claims, 1 Drawing Figure

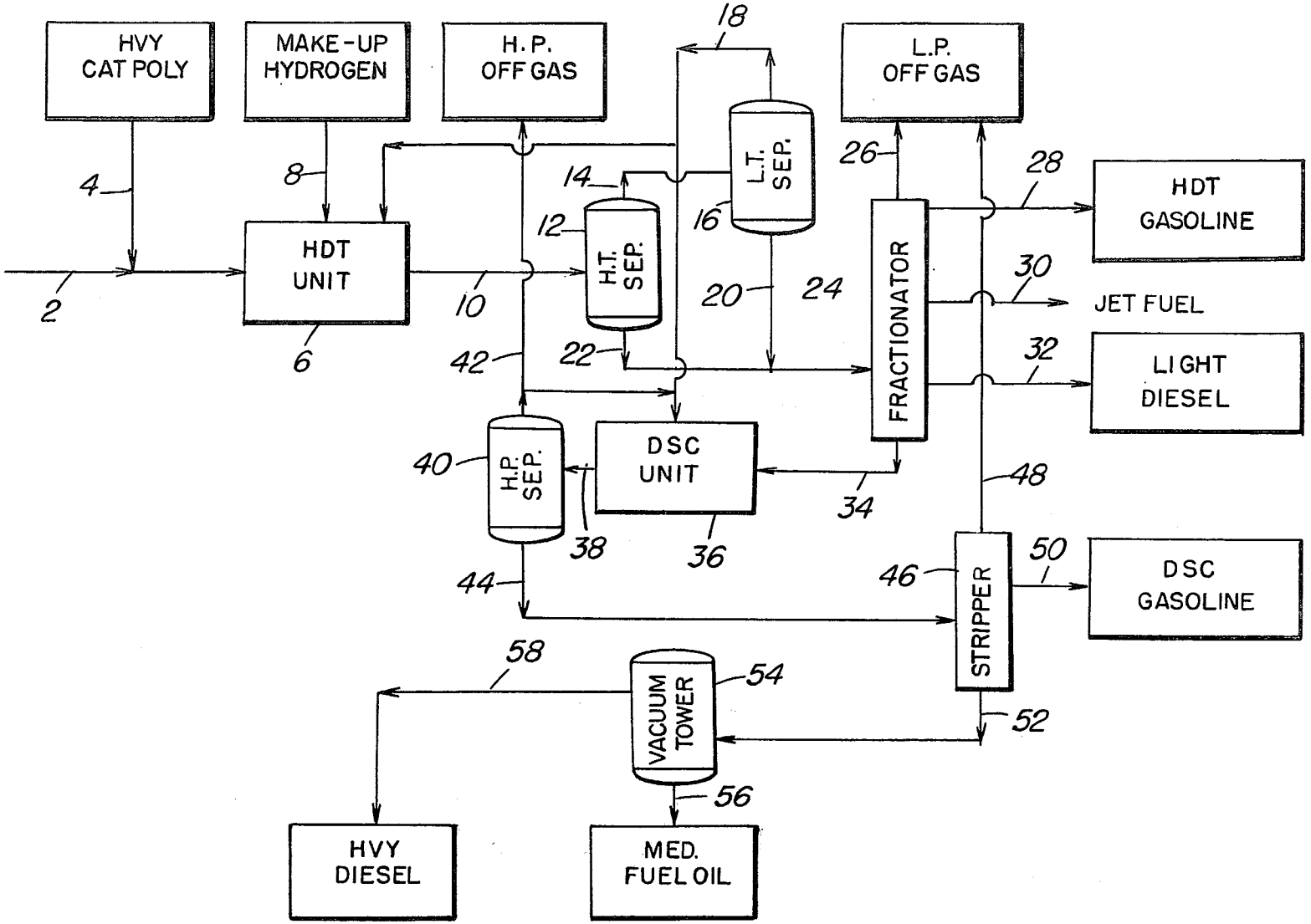
HVY CAT POLY
MAKE-UP HYDROGEN
H.P. OFF GAS
L.P. OFF GAS
HDT GASOLINE
JET FUEL
LIGHT DIESEL
DSC GASOLINE
HDT UNIT
H.T. SEP.
L.T. SEP.
FRACTIONATOR
DSC UNIT
H.P. SEP.
STRIPPER
VACUUM TOWER
MED. FUEL OIL
HVY DIESEL
2
4
6
8
10
12
14
16
18
20
22
24
26
28
30
32
34
36
38
40
42
44
46
48
50
52
54
56
58

METHOD FOR UPGRADING SYNTHETIC OILS BOILING ABOVE GASOLINE BOILING MATERIAL

FIELD OF THE INVENTION

The invention relates to a method and process combination for upgrading synthetic oils such as coal-derived oils boiling generally above gasoline boiling range material. More particularly, the present invention relates to upgrading products of Fisher-Tropsch Synthesis and comprising hydrocarbons and oxygenates boiling above about 300° F and up to about 850° F or 975° F.

PRIOR ART

Processes for the conversion of coal and other hydrocarbons such as natural gas to a gaseous mixture consisting essentially of hydrogen and carbon monoxide, or of hydrogen and carbon dioxide, or of hydrogen and carbon monoxide and carbon dioxide, are well known. Although various processes may be employed for the gasification, those of major importance depend either on the partial combustion of the fuel with an oxygen-containing gas or on a combination of these two reactions. An excellent summary of the art of gas manufacture, including synthesis gas, from solid and liquid fuels, is given in Encylcopedia of Chemical Technology, Edited by Kirk-Othmer, Second Edition, Volume 10, pages 353–433, (1966), Interscience Publishers, New York, New York, the contents of which are herein incorporated by reference.

It is desirable to effectively and efficiently convert synthesis gas, obtained from coal, natural gas or any other available source to highly valued hydrocarbons such as motor gasoline of relatively high octane number diesel fuel, petrochemical feedstocks liquefiable petroleum fuel gas, and aromatic hydrocarbons. It is well known that synthesis gas will undergo conversion to form reduction products of carbon monoxide, such as oxygenates and hydrocarbons, at temperatures in the range of about 300° F to about 850° F under pressures of from about one to one thousand atmospheres pressure, over a fairly wide selection of catalyst compositions. The Fischer-Tropsch process, for example, which has been most extensively studied, produces a range of products including oxygenates, heavy waxy oils, and liquid hydrocarbons which have been used as low octane gasoline. The types of catalysts that have been studied for this and related processes include those based on metals or oxides of iron, cobalt, nickel, ruthenium, thorium, rhodium and osmium.

The wide range of catalysts and catalyst modifications disclosed in the art and an equally wide range of conversion conditions used in the reduction of carbon monoxide by hydrogen contribute some flexibility toward obtaining a variety of different boiling-range products. Nonetheless, in spite of this flexibility, it has not proved possible to produce substantial quantities of liquid hydrocarbons in the gasoline boiling range which contain highly branched paraffins and substantial quantities of aromatic hydrocarbons, both of which are required for high quality gasoline, or to selectively produce aromatic hydrocarbons particularly rich in the benzene to xylenes range. A review of the status of this art is given in "Carbon Monoxide-Hydrogen Reactions", Encyclopedia of Chemical Technology, Edited by Kirk-Othmer, Second Edition, Volume 4, pp. 446–448, Interscience Publishers, New York, New York, the text of which is incorporated herein by reference.

SUMMARY OF THE INVENTION

This invention is concerned with a processing combination operation comprising a relatively mild hydrogenation of olefinic hydrocarbons in the presence of relatively high concentrations of oxygenates and boiling above 300° F and more usually within the range of about 400° F to about 915° F or 975° F. A heavy portion of the hydrogenated feed is thereafter subjected to selective cracking with one of a special group of crystalline zeolite catalyst. The present invention is particularly concerned with the method and means for upgrading carbon monoxide reduction products comprising oxygenates and hydrocarbons higher boiling than 300° F to produce high octane gasoline, light and heavy fuel oils of desired pour point.

In the combination operation of this invention, it is particularly contemplated processing a product of Fischer-Tropsch Synthesis comprising a mixture of a light oil boiling above 300° F or 325° F and higher boiling decant oil product boiling up to 850° or 975° F. Thus, the synthetic oil product processed by the combination of this invention to produce fuel oil products is higher boiling than gasoline and will contain a substantial portion of the higher boiling oxygenates formed in a Fischer-Tropsch Synthesis operation. It is also contemplated including with the feed, passed to the hydrogenation step, a portion of an olefinic product of catalytic polymerization boiling above about 370° F. Thus, it is contemplated processing as much as 20 volume percent of a heavy olefinic gasoline product of catalytic polymerization with the high boiling synthetic product of carbon monoxide reduction.

In one particular embodiment, it is contemplated within the scope of this invention of hydrotreating a blend of the aforesaid light oil and decant oil product of Fischer-Tropsh Synthesis boiling above about 400° F and particularly identified in Table 1 below.

TABLE 1

| DECANT OIL PROPERTIES | | |
|---|---|---|
| TBP Cut Point ° F | 400–890 (Measured) | 400–915 (Estimated) |
| Chemical Analysis | | |
| Sulfur, ppm | 40 | 45 |
| Nitrogen, ppm | 10 | 10 |
| Hydrogen % wt. | 12.68 | 12.6 |
| Oxygen, % wt. | 1.90 | 1.5 |
| Iron, ppm | 5.9 | 6.0 |
| Physical Properties | | |
| Gravity, ° API | 37.2 | 37.0 |
| Specific Gravity, 60/60° F | 0.8388 | 0.8398 |
| Molecular wt. | 250 | 251 |
| Pour Point ° F | 65 | 70 |
| Acid No., Mg KOH/grams | 2.99 | 2.9 |
| Bromine No. g Br/100 grams | 34.8 | 34.7 |
| Conf. Diolefins, M-moles/gram | 0.194 | 0.19 |
| Conradson Carbon, wt. % | 0.06 | 0.10 |
| Distillation ° F at IBP | 428 | 428 |
| 10% | 466 | 467 |
| 30% | 510 | 512 |
| 50% | 574 | 580 |
| 70% | 655 | 662 |
| 90% | 777 | 790 |
| 95% | 824 | 845 |
| Estimated E. P. | (890) | (915) |

In the hydrotreating operation of this invention, the reactions are generally quite mild but highly exothermic due to the rapid hydrogenation of olefins and oxygenates in the feed charged. Thus, hydrogen concentrations are required in the hydrotreating operation sufficiently high to effect hydrogenation of olefins and oxygenates in combination with cooling of the products of the exothermic reaction encountered as with cool hydrogen rich recycle gas introduced between two or more spaced apart catalytic beds. A hydrogen requirement at the hydrogenation reactor inlet within the range of 1000 to 3000 SCF/bbl is contemplated. A total pressure within the range of 300 to 1200 psig at the hydrotreating reactor inlet is contemplated. A hydrogen partial pressure at the reactor outlet within the range of 200 to 1000 psia is also contemplated.

The hydrogenation catalysts particles employed in the fixed catalyst bed reactor system herein contemplated are sized to restrict pressure drop in the multiple catalyst bed reactor within predetermined desired limits. The catalyst comprises a mixture of cobalt and molybdenum on an alumina matrix material in a particular embodiment. The catalyst comprises about 6 wt % cobalt and 12 wt % of molybdena. The catalyst is a highly effective catalyst for the mild hydrotreating operation herein contemplated. However, other hydrogenation catalyst combinations may also be effectively employed such as nickel-molybdenum, nickel-cobalt-molybdena, nickel-tungsten and others known in the prior art distributed in suitable matrix material. In the hydrotreating operation, it is important to catalyst life that the hydrogen partial pressure be of a relatively high order of magnitude. More important, however, is the requirement that the catalyst be maintained in a sulfided condition. The synthetic feed prepared by Fischer-Tropsch Synthesis is relatively low in sulfur, usually in the range of about 30 ppm to 50 ppm weight. Therefore, it is important to not only presulfide the hydrogenation catalyst but also to maintain the sulfided slate of the catalyst during mild hydrogenation by the continuous addition of a suitable sulfiding compound in a form providing sulfur in amounts within the range of 20 to 250 ppm weight based on feed.

In the hydrotreating operation of this invention, it has been found that the sulfur compounds in the feed are not sufficient by themselves to maintain the catalyst in a sulfided condition in the presence of the oxygenates and the hydrogen requirements of the process. Thus, a suitable sulfur activating compound must be added to the operation and in amounts providing at least 200 ppm $H_2S$ in the separated off gas or hydrogen rich recycle gas.

During the hydrotreating (hydrogenation) operations herein discussed, processing oxygenates olefins and diolefins in the feed, hydrocarbonaceous material is deposited on the catalyst thereby operating to reduce the activity of the catalyst for accomplishing the results desired. Thus, when the catalyst acquires an amount of hydrocarbonaceous deposits undesirably affecting its catalytic activity, it then must be regenerated to remove the carbonaceous deposits. This is accomplished with an oxygen containing gas such as one might obtain with a steam-air mixture or nitrogen-air mixtures or scrubbed flue gas enriched with oxygen at a pressure within the range of 50 to 500 psig or more but usually in the range of 100 to 200 psig at a temperature restricted to within the range of 700° to 950° F. Start of run regeneration temperatures are usually kept adjacent the lower end of the temperature spread. A steam-air mixture is particularly preferred.

The hydrotreating operation of this invention contemplates processing a wide boiling range olefinic charge material comprising oxygenates and higher boiling waxy products of Fischer-Tropsch Synthesis. The oil charge may be restricted to boil in a relatively narrow boiling range of about 400° F up to about 850° F or a wide boiling range fraction within the range of about 300° F up to about 915° or 975° F may be processed. It may also be particularly restricted to boil initially within the range of 350° to 400° F up to about 725° F.

The feed materials herein identified may be hydrotreated alone or in admixture with an olefinic product of catalytic polymerization boiling above 300° or 370° F and particularly the heavy boiling product thereof boiling up to about 600° F. Other sources of oils such as creosotes and phenols may also be hydrotreated before being a part of the products desired herein. When processing a Fischer-Tropsch Synthesis product boiling up to 975° F, it is important to maintain the reactant space velocity within the range of 0.5 to 5.0 V/V/hr or more specifically about 1 to 3 LHSV because of the coking tendency of the feed components boiling above 600° F.

In the combination operation of this invention, the product effluent of the hydrotreating operation is separated in a combination of steps to obtain water, gaseous material, a naphtha or gasoline fraction boiling below about 400° F from higher boiling hydrotreated material. A high boiling fraction of the hydrotreating operation identified in Table 2 below and comprising high boiling waxy material is recovered and processed by selective cracking to provide fuel oils or reduce pour point and a high octane gasoline product.

TABLE 2

| Fractionator System Bottoms | |
|---|---|
| Boiling Range ° F | Vol. % |
| 400–450 | 9.2 |
| 450–500 | 11.7 |
| 500–600 | 18.2 |
| 600–700 | 22.5 |
| 700–800 | 32.1 |
| 800 + Bottoms | 6.3 |
| | 100.0 |

In the combination of this invention, a separated, relatively heavy hydrogenated product is generally a relatively rough cut fraction boiling above 350° F up to about 975° F. This high boiling hydrogenated product is thereafter selectively cracked with one of a special class of crystalline zeolite conversion catalyst represented by a ZSM5 crystalline zeolite conversion catalyst.

The selective cracking operation is maintained under conditions to particularly convert waxy paraffinic materials to lower boiling components including gasoline as well as light and heavy fuel oils of lower freeze point than the feed charged. The hydrodewaxing operating conditions may include a liquid hourly space velocity between 0.5 to 5, a reactor temperature between 500° F and 900° F and an elevated pressure within the range of 200 psig pressure up to about 1000 psig of pressure. The product effluent of the crystalline zeolite selective cracking operation is recovered and separated in a suitable product recovery fractionation operation. The products of hydrotreating and selective cracking are separated in one or more common or separate separation operation. Since, the gasoline product of the selective cracking step is a higher octane product than the hydrotreated product it is preferred to keep them separate.

The catalytic hydrodewaxing of a previously hydrogenated 350° F plus fraction by the selective cracking step of the combination operation is accomplished at a temperature preferably within the range of about 500° F up to about 850° F at a hydrogen partial pressure within the range of 200 to 500 psia.

The hydrogenated waxy fraction brought in contact with the special zeolite catalyst such as a ZSM5 crystalline zeolite distributed in an alumina, silica alumina or clay matrix converts the high pour paraffins and any remaining olefinic components to high octane gasoline product of at least about 85 O.N. clear and fuel oil products of low pour characteristics. The special zeolite catalyst may be used alone or it may be promoted with a hydrogenation component. Hydrogenation components suitable for this purpose include a Group VIII metal such as nickel, platinum, palladium, rhodium ruthenium and other known hydrogenation components.

It will be observed from the information presented herein that a yield shift may be had depending on the selected end point of the gasoline boiling range material. Thus, the gasoline end point may be selected from within the range of about 300° to about 430° F; the lower end point being selected when it is desired to increase the yield of fuel oils and/or develop a suitable jet fuel fraction from products of the combination operation. Also, in the combination of this invention, the pour point of materials boiling above about 650° F is sufficiently reduced for use as diesel fuel or a heavy fuel product.

The special zeolite catalysts referred to herein utilize members of a special class of zeolites exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e. high silica to alumina ratios, they are very active. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conducive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon of aluminum atoms at the centers of the tetrahedra. Briefly, the preferred zeolites useful as catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other forms within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of twelve-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted between 550° F and 950° F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on steam, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}\ (\text{fraction of n-hexane remaining})}{\log_{10}\ (\text{fraction of 3-methylpentane remaining})}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-Alumina | 0.6 |
| Erionite | 38 |

The above-described Constraint Index is an important and even critical, definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above defined range of 1 to 12.

Thus, it should be understood that the "Constraint Index" value as used herein is an inclusive rather than an exclusive value. That is, a zeolite when tested by any combination of conditions within the testing definition set forth herein above to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. application, Ser. No. 358,192, filed May 7, 1973, now abandoned, the entire contents of which are incorporated herein by reference, describes a zeolite composition, and a method of making such, designated as ZSM-21 which is useful in this invention.

U.S. application Ser. No. 528,061 filed Nov. 29, 1974, now U.S. Pat. No. 4,016,245, the entire contents of which are incorporated herein by reference, describes a zeolite composition including a method of making it. This composition is designated ZSM-35 and is useful in this invention.

U.S. application Ser. No. 528,060, filed Nov. 29, 1974, now abandoned, the entire contents of which are incorporated herein by reference, describes a zeolite composition including a method of making it. This composition is designated ZSM-38 and is useful in this invention.

The x-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F for one hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments such as base exchange, steaming, alumina extraction, and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12, and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged H-ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of article on Zeolite Structure by W. M. Meier. This paper, the entire contents of which are incorporated herein by reference, is included in "Proceedings of the Conference on Molecular Sieves, London, April 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolite is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | | Framework Density | |
|---|---|---|---|---|
| Ferrierite | 0.28 | cc/cc | 1.76 | g/cc |
| Mordenite | .28 | | 1.7 | |
| ZSM-5, -11 | .29 | | 1.79 | |
| Dachiardite | .32 | | 1.72 | |
| L | .32 | | 1.61 | |
| Clinoptilolite | .34 | | 1.71 | |
| Laumontite | .34 | | 1.77 | |
| ZSM-4 (Omega) | .38 | | 1.65 | |
| Heulandite | .39 | | 1.69 | |
| P | .41 | | 1.57 | |
| Offretite | .40 | | 1.55 | |
| Levynite | .40 | | 1.54 | |
| Erionite | .35 | | 1.51 | |
| Gmelinite | .44 | | 1.46 | |
| Chabazite | .47 | | 1.45 | |
| A | .5 | | 1.3 | |
| Y | .48 | | 1.27 | |

The drawing is a diagrammatic block flow arrangement of processing steps for upgrading a synthetic product of Fischer-Tropsch Synthesis to more valuable gasoline, light and heavy oil products.

Referring now to the drawing, an oil product of Fishcher-Tropsch Synthesis boiling above about 300° F up to about 915° F or 975° F and comprising oxygenates is charged to the process by conduit 2. The synthetic feed with or without added heavy product of catalytic polymerization introduced thereto by conduit 4 is charged as feed to a hydrotreating operation in unit 6. Make up hydrogen required in the hydrotreating operation is charged to the hydrotreating unit 6 by conduit 8 as well as hydrogen rich recycle gas obtained as hereinafter provided. The hydrotreating unit comprises a hydrogenation zone and related heat exchange equipment and a reactor arrangement for processing the feed through a plurality of separate beds of hydrogenating catalyst maintained in a sulfided condition. Thus, the catalyst such as a cobalt molybdenum hydrogenation catalyst composition is presulfided before contact with the feed and thereafter maintained in a sulfided condition by the substantially continuous addition of a sulfur compound with the feed in the amount required. The hydrotreating operation is maintained at a temperature within the range of 450° F to 850° F and a total pressure at the hydrotreating reactor inlet of at least about 300 psig in the hydrotreating operation. The hydrotreating operation is a relatively mild operation in that it does not completely desulfurize the oil feed comprising up to about 40 ppm sulfur in the feed but on the other hand the operation is sufficiently severe to hydrogenate olefins in the feed and convert oxygenates to hydrocarbons products and water. These reactions are exothermic and therefore impose a requirement with respect to controlling the exothermic temperature heat gain within relatively narrow limits. In this exothermic environment, it is proposed to restrict the temperature gain in any bed of catalyst not to exceed about 75° F and the operating cycle of the reactor system from start of run to end of run may vary within a temperature range of about 500° F to 850° F but the reactor exothermic temperature gain between reactor inlet and reactor outlet should not be permitted to exceed more than about 250° F. The exothermic catalytic restrictions are cooperatively attained by restrictions on catalyt bed depth and quench fluid used in the reactor system.

A hydrotreated product is recovered from unit 6 at an elevated temperature by conduit 10 and passed to a high temperature separator 12 maintained at a temperature within the range of about 300° F to 750° F and a total pressure in the range of 300 to 1000 psig. In separator 12, a separation is made to recover materials boiling below about 550° F from higher boiling hydrogenated product. The lower boiling fraction is withdrawn from separator 12 by conduit 14 communicating with a low temperature separator 16 maintained at a temperature within the range of 75 to 200° F and a pressure within the range of 275 to 975 psig. A hydrogen rich recycle gas comprising up to 250 ppm or more of sulfur is recovered from separator 16 by conduit 18 for recycle to the hydrotreating unit herein discussed. Material higher boiling than the hydrogen rich gas separated in separator 16 is withdrawn by conduit 20 and combined with the high boiling product separated in separator 12 and withdrawn therefrom by conduit 22. The combined stream is thereafter heated in a furnace not shown and then passed to a fractionation system 24.

In fractionation system 24, maintained at a temperature within the range of 100° F to 800° F and a pressure within the range of 0 to 100 psig a separation is made to recover low pressure fuel gas withdrawn therefrom by conduit 26 for further use as most appropriate. A gasoline product of the hydrotreating operation is recovered and withdrawn by conduit 28. A jet fuel boiling range material may be separated and withdrawn by conduit 30 from a light diesel fuel recovered by conduit 32. On the other hand, material higher boiling than gasoline may be recovered as the light diesel fuel when the recovery of a separate jet fuel is not pursued. Thus, the gasoline may have an end boiling point within the range of about 300° F up to about 430° F or higher, the light diesel fuel may have an end point in the range of about 500° F to 750° F and a jet fuel fraction may have an end point within the range of about 400° F to about 550° F.

A bottoms fraction higher boiling than the recovered light diesel fraction is recovered from a lower portion of the fractionation system 24 by conduit 34 communicating with a selective cracking unit operation 36. In the selective cracking operation, a hydrogenated feed boiling above about 550° F or a material higher boiling then jet fuel is selectively cracked in the presence of hydrogen at a partial pressure of at least about 200 psia and a selective crystalline zeolite cracking catalyst of the class represented by ZSM5 crystalline zeolite. The selective cracking catalyst may be promoted with a hydrogenation component. It is also contemplated using as a feed charge, material generally higher boiling than a light diesel fuel depending on whether one desires to reduce the pour point thereof.

As mentioned above, the selective cracking operation is maintained preferably at a temperature within the range of about 550° to 770° F with an initial conversion temperature of about 570° F preferred. The selective cracking operation is preferably completed at a hydrogen partial pressure within the range of 350 to 400 psia.

A product effluent is recovered from the selective cracking operation by conduit 38 communicating with a high pressure separator 40 maintained at a temperature within the range of 75° to 200° F and a pressure within the range of 200 to 1000 psig depending upon hydrogen purity. In separator 40, a high pressure fuel gas is separated and recovered by conduit 42 from higher boiling product recovered from the bottom of the separator by conduit 44. All or a portion of the separated high pressure gas withdrawn by conduit 42 may be recycled to the selective cracking operation. Depending on the hydrogen purity of this gas stream it may be necessary to add some fresh make up hydrogen to this recycle stream. A stream of product higher boiling than the separated gas stream and comprising material boiling in the range of about $C_5$ hydrocarbons up to about 975° F is separated and withdrawn by conduit 44. The material in conduit 44 is passed to a product stripping or fractionation zone 46 wherein a separation is made to recover low pressure fuel gas withdrawn by conduit 48, a high octane gasoline fraction withdrawn by conduit 50 and material higher boiling than gasoline being withdrawn by conduit 52. Material boiling above gasoline in conduit 52 is passed to a vacuum separation zone 54 wherein a separation is made to recover a medium boiling range fuel oil from a heavy diesel oil fraction. The medium fuel oil is recovered by conduit 56 and the heavy diesel oil is recovered by conduit 58.

Having thus generally described the combination process of this invention and described specific embodiments going to the very essence thereof, it is to be understood that no undue restrictions are to be imposed by reasons thereof except as defined by the following claims.

We claim:

1. A method for upgrading a product of Fischer-Tropsch synthesis boiling above 300° F comprising hydrocarbons and oxygenates which comprises, hydrogenating said product of Fischer-Tropsch synthesis boiling above 300° F at a temperature within the range of 450° F to 850° F and a hydrogen partial pressure of at least 200 psia by contact with a sulfided hydrogenation catalyst, separating the product effluent of said hydrogenation operation in a high temperature separator into a first low boiling fraction and a first higher boiling fraction, separating the thus obtained first low boiling fraction in a lower temperature separator into a first hydrogen rich recycle gas stream and a second higher boiling product stream, passing the separated first and second higher boiling streams of said high and lower temperature separation zones to a lower pressure separation zone maintained at a temperature within the range of 100° F to 800° F to recover a low pressure fuel gas stream, a gasoline product stream, a light diesel fuel product stream and a hydrogenated higher boiling product stream boiling above about 500° F, selectively converting said separated hydrogenated product stream boiling above about 500° F by contacting a crystalline zeolite conversion catalyst providing a pore opening of at least 5 Angstroms, a constraint index within the range of 1 to 12 and a silica to alumina ratio of at least 12 under temperature conditions within the range of 550° to 770° F and a hydrogen pressure within the range of 200 to 400 psia, separating the product of said crystalline zeolite conversion operation in a high pressure separation zone at a temperature selected to provide a hydrogen containing gaseous product stream separately from a higher boiling product fraction, separating the higher boiling product fraction of said conversion operation under lower pressure conditions to provide a gasoline product of said conversion operation separate from material boiling above said gasoline product, further separating said material higher boiling than said gasoline product into a medium fuel oil product and a heavy diesel oil product fraction, and cascading hydrogen rich gases separated from said hydrogenated product effluent in said low temperature separation zone to said crystalline zeolite conversion operation as a major source of hydrogen therefor.

2. The method of claim 1 wherein the hydrogenation catalyst is maintained in a sulfided condition by the addition of a sulfur compound to the feed being hydrogenated.

3. The method of claim 1 wherein the zeolite conversion catalyst is provided with a hydrogenation metal component which is sulfided.

4. The method of claim 1 wherein hydrogen containing gas separated from the product of said hydrogenation operation and said zeolite conversion operation is recycled in part to such operation from which obtained.

* * * * *